United States Patent [19]

Palmer et al.

[11] Patent Number: 4,664,382

[45] Date of Patent: May 12, 1987

[54] COMPACT PORTABLE GOLF CLUB SET AND CARRYING BAG

[75] Inventors: Richard J. Palmer, Playa Del Rey, Calif.; Raymond Banham, Chislehurst; Colin Woodcock, Essex, both of England

[73] Assignee: Global Golf Incorporated, Torrance, Calif.

[21] Appl. No.: 818,371

[22] Filed: Jan. 13, 1986

[51] Int. Cl.[4] ..... A63B 53/12; A63B 53/02; A63B 53/16; A63B 55/00

[52] U.S. Cl. ..... 273/77 A; 273/81.2; 273/80.1; 206/315.6

[58] Field of Search ..... 206/315.6, 315.4, 315.7, 206/315.8, 315.3; 273/77 A, 80 D, 80.1, 81.2

[56] References Cited

U.S. PATENT DOCUMENTS

| | | | |
|---|---|---|---|
| 2,009,072 | 7/1935 | Sampson | 206/315.6 X |
| 2,464,850 | 3/1949 | Crawshaw | 273/80.1 |
| 3,848,737 | 11/1974 | Kenon | 206/315.9 X |
| 4,332,283 | 6/1982 | Rader | 206/315.6 |
| 4,340,227 | 7/1982 | Dopkowski | 273/80.1 X |
| 4,429,875 | 2/1984 | Stanton | 273/80.1 X |

FOREIGN PATENT DOCUMENTS

| | | | |
|---|---|---|---|
| 325677 | 2/1930 | United Kingdom | 273/80.1 |

*Primary Examiner*—George J. Marlo
*Attorney, Agent, or Firm*—Edward A. Sokolski

[57] ABSTRACT

A set of golf clubs has a detachable shaft portion such that a whole set of clubs can be utilized with a single top shaft element which can be firmly but removably attached to a shortened shaft portion provided with each club head. A carrying bag is provided for the clubs and shaft, this bag having a plurality of tubular receptacles, one for each club or shaft. A row of such receptacles is attached to each of the sides of the bag. The receptacles in each row have successively greater lengths and are arranged to form a stepped configuration so that the clubs will when installed in their receptacles have their heads in different levels in the bag for easy selection. A third row of receptacles are attached to each other and at one end of the row connected by a flexible connector to the rear of the bag so that the entire row will pivot both to facilitate selection of the clubs and to provide a compact assembly for carrying. The receptacles have caps on their ends with resilient finger portions to hold the clubs in a central position therein.

7 Claims, 13 Drawing Figures

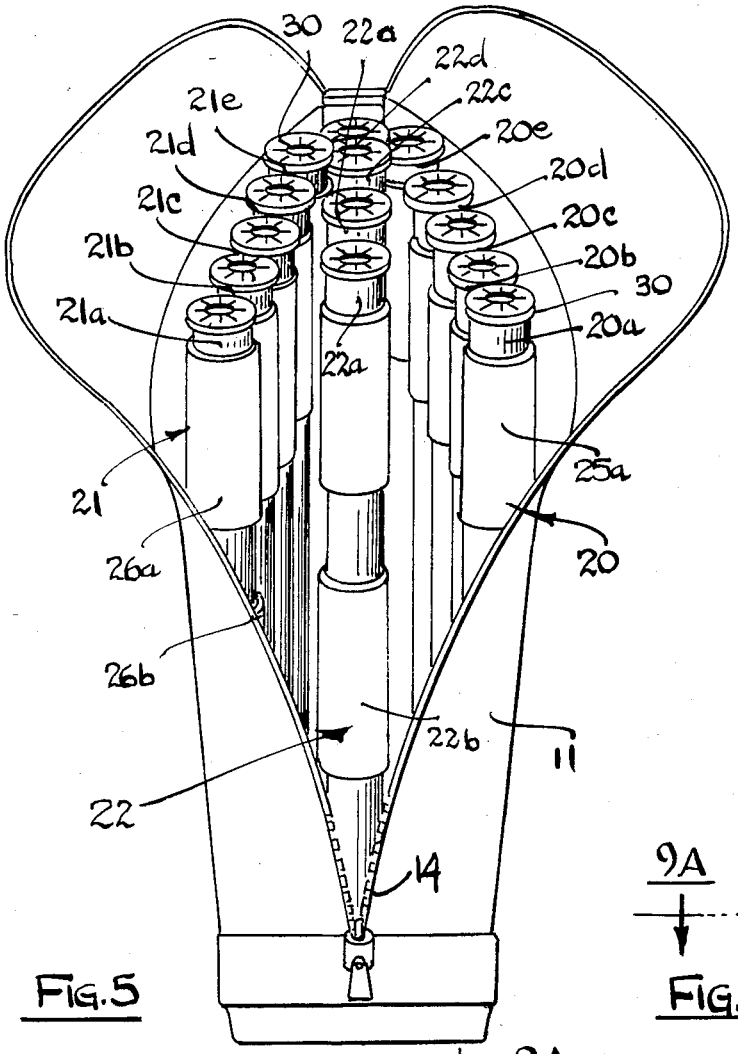
FIG. 5
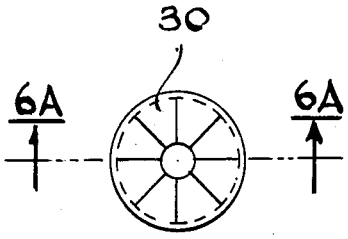
FIG. 6
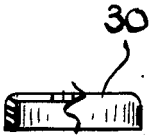
FIG. 6A
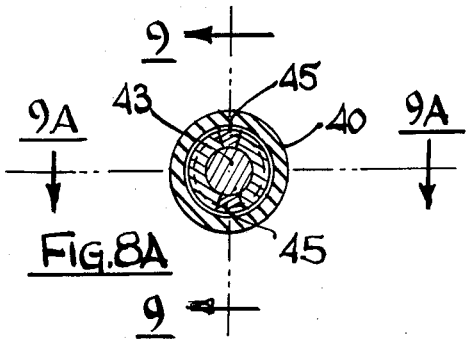
FIG. 8A
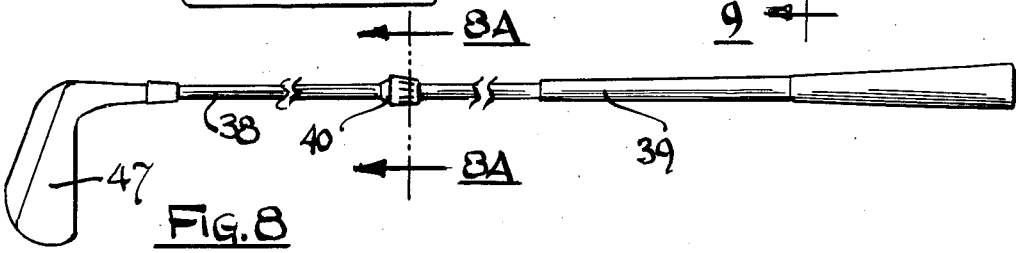
FIG. 8
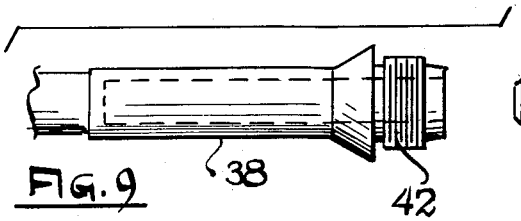
FIG. 9
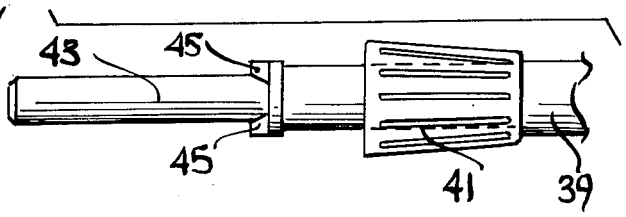
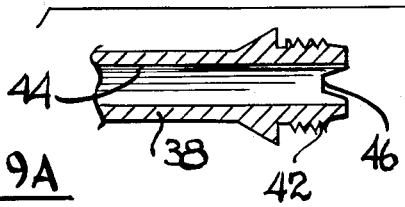
FIG. 9A
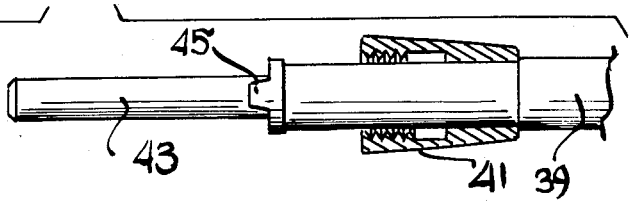

COMPACT PORTABLE GOLF CLUB SET AND CARRYING BAG

This invention relates to golf clubs and bags and more particularly to a compact golf club set employing a single detachable shaft with a set of club heads with shortened shaft portions and a carrying bag therefore.

Particularly for the traveler, it is difficult to take along a regular set of golf clubs, especially when travelling by air. An approach to solving this problem is to utilize a single shaft which can be removably attached to any one of a number of golf club heads provided in a set of such heads. Such devices are described in prior art U.S. Pat. Nos. 2,464,850 to Crawshaw; 3,524,646 to Wheeler; 3,891,212 to Hill; 4,253,666 to Murphy; 3,848,737 to Kenon; and 4,340,227 to Dopkowski. A particular problem that is encountered with detachable golf club shafts is the failure to get a good solid coupling between the shaft and the club head which results in a lack of a solid feel to the club. Many of the devices of the prior art fail to achieve a solid coupling with the above indicated disadvantage. U.S. Pat. Nos. 3,848,737 to Kenon and 4,340,227 to Dopkowski describe carrying cases used in conjunction with golf sets with a detachable shaft. The device of the present invention is an improvement over such prior art golf club sets employing detachable shafts which are carried in a carrying bag to make for a compact package which can easily be carried and transported. The club head portions and shaft are connected together with a coupling which provides firm joinder between the two sections yet which can readily be assembled and disassembled. The carrying bag holds the club heads and shaft in a staggered stepped fashion so that the club heads can easily be identified for selection, each club being in a separate retaining sleeve compartment.

The improvement is achieved in the present invention by including a substantial section of shaft with each club head and by joining each of the shafted heads with a common top shaft section by means of a coupler which may be splined to provide a rigid joint which has no slack either rotationally or longitudinally. The carrying bag has a plurality of tubular sleeve members which are joined together in rows, there being a row of said members attached to the opposite inner side walls of the bag and a row of such members attached to the inner end wall of the bag by means of a flexible flap such that the central row will move pivotally in the bag. The tubular sleeve members are staggered in height and arranged in a stepped fashion so that the club heads and their shaft portions will be in a stepped arrangement when installed in the bag for easy identification and selection. The bag is zippered so both its top and substantially the entire length of one side can be opened up to enable ready access to the interior of the bag which can also be used to carry shoes, golf balls, etc. in zippered inner side compartments.

It is therefore an object of this invention to facilitate the carrying and transportation of a set of golf clubs.

It is a further object of this invention to provide an improved shaft detachable golf club set with which a single shaft can be used with a plurality of golf heads and wherein a firm coupling is provided between the detachable shaft and the club head portion.

It is still a further object of this invention to provide an improved carrying bag for use with a set of golf clubs which operate with a single detachable shaft.

Other objects of this invention will become apparent as the description proceeds in connection with the accompanying drawings of which:

FIG. 5 is a front perspective view of the preferred embodiment with the bag fully opened;

FIG. 6 is a top plan view of the sleeve member caps of the preferred embodiment;

FIG. 6A is a cross sectional view taken along the plane indicated by 6A—6A in FIG. 6;

FIG. 8 is a side elevational view showing one of the clubs of the preferred embodiment joined to its shaft;

FIG. 8A is a cross sectional view taken along the plane indicated by 8A—8A in FIG. 8;

FIG. 9 is a cross sectional view taken along the plane indicated by 9—9 in FIG. 8A;

FIG. 9A is a cross sectional view taken along the plane indicated by 9A—9A in FIG. 8A.

Figure 1:
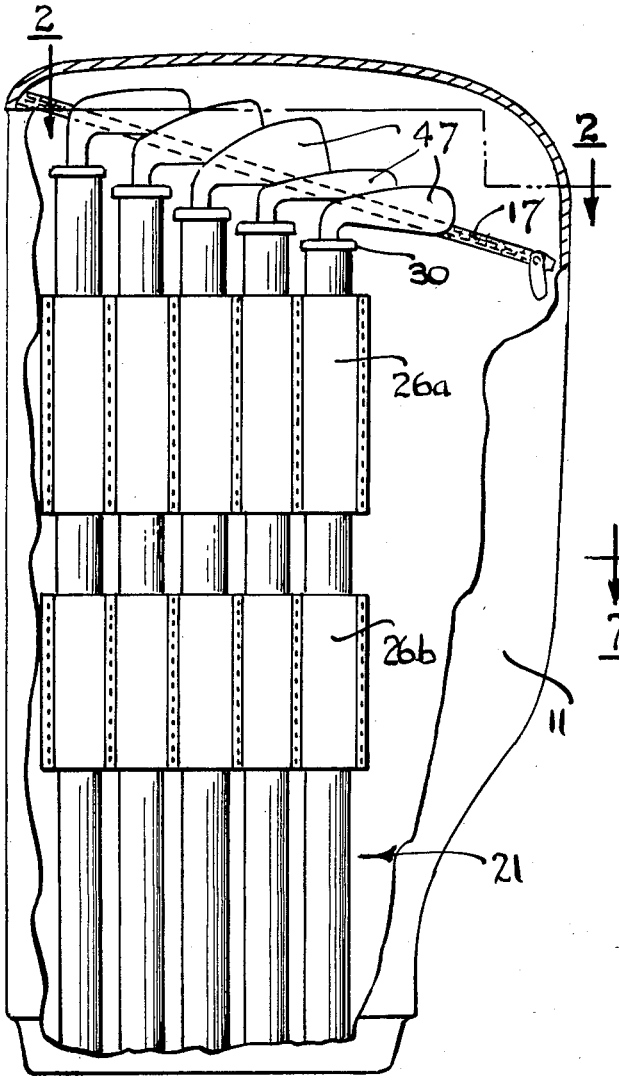
FIG. 1 is a side elevational view of the preferred embodiment of the invention with a cutaway section.

Referring now to FIGS. 8, 8A, 9 and 9A, the detachable shaft and head-shaft units of the invention are illustrated along with the coupler for providing joinder between these elements.

Upper shaft section 39 is removably joined to to the shaft of club head-shaft section 38 by means of coupler member 40. Coupler member 40 includes an internally threaded cap 41 slidably mounted on shaft 39 and a mating threaded portion 42 formed in shaft section 38. Shaft 39 further has an extension 43 which slidably fits within the sleeve 44 formed in the end of shaft section 38. A splined coupling is formed by tooth portions 45 formed on shaft 39 and groove portions 46 formed on the end of shaft section 38, these tooth and groove portions matingly engaging each other when cap 41 is tightened on threaded portion 42. In this matter a firm joinder is provided between shaft 39 and each shaft section 38 in turn, this joinder operating to prevent any twisting movement between the shaft 29 and the mating shaft section 38 at the movement of impact with the golf ball. At the same time, the two pieces are easily and rapidly attachable and detachable from each other.

Figure 3:
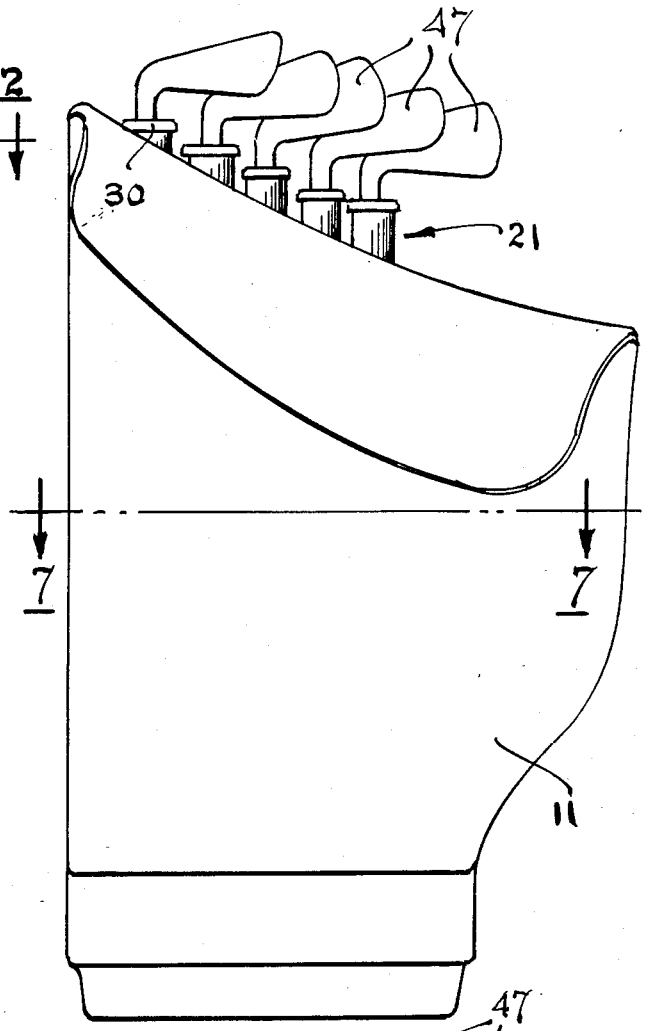
FIG. 3 is a side elevational view of the preferred embodiment with the top of the bag open.
Figure 2:
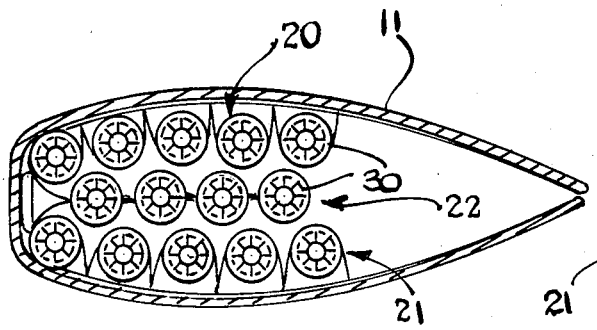
FIG. 2 is a top plan view taken along a plane indicated by 2—2 in FIG. 1.

Referring now to FIGS. 1–7 and 10, the golf bag for carrying the club head-shaft sections and the upper shaft sections is illustrated. As can best be seen in FIGS. 2, 4, 5 and 7, the device of the invention includes a flexible bag 11, which is zippered closed with a single zipper 14 that runs along the side and top portions thereof. The bag also includes zippers 17, 18 and 19 which are used to close compartments formed along the inner walls of the bag for use in carrying shirts, golf balls, shoes, etc. Additional space is provided in the main compartment of the bag for shoes and other larger articles. Installed in the bag are a plurality of cylindrical rigid sleeve compartments 20*a*–20*e* 21*a*–21*e* and 22*a*–22*d* for carrying the golf club heads 47 and their attached shaft portions as well as the upper shaft sections 39 for attachment to the club head sections. Sleeve compartment members 20*a*–20*e* are arranged to form a row 20. This row of sleeve members being attached to inner side wall 11*a* of the bag by means of a pair of strap members 25*a* and 25*b* which as can best be seen in FIG. 7, loop around the sleeve compartments and are stitched to the side of the bag. Tubular sleeve compartment members 21*a*14 21*e* are similarly arranged in a row 21 and attached to side wall 11*b* of the bag by means of straps 26*a* and 26*b* in the same manner as described by the row of sleeve members 20. As best can be seen in FIGS. 3 and 5 the sleeve members forming rows 20–22 have graduated lengths and are arranged to form a stepped configuration going from the front of the bag to the rear. A cap member 30 is provided over the top end of each of the sleeves, these cap members having resilient inwardly extending flexible fingers 30*a* which grip the shafts and keep the club heads in a centered retained position yet enable the ready withdrawal of the club heads for use. A central row 22 of sleeves is held together by an encircling strap member 35 which terminates in a pair of flap members 35*a* and 35*b* which are stitched to the rigid end wall 11*c* of the bag. This provides a flexible attachment for this row so that it can be moved from left to right as may be desired by the user to facilitate the withdrawal and redepositing of the club heads and shafts in their respective sleeve compartments. The bag is kept rigid so that it stands upright and remains rigid while being earned by means of rigid end wall 11*c* which runs the entire vertical extent of the bag and effectively forms a spine therefor. The tubular sleeve compartments further contribute to such rigidity.

Figure 4:
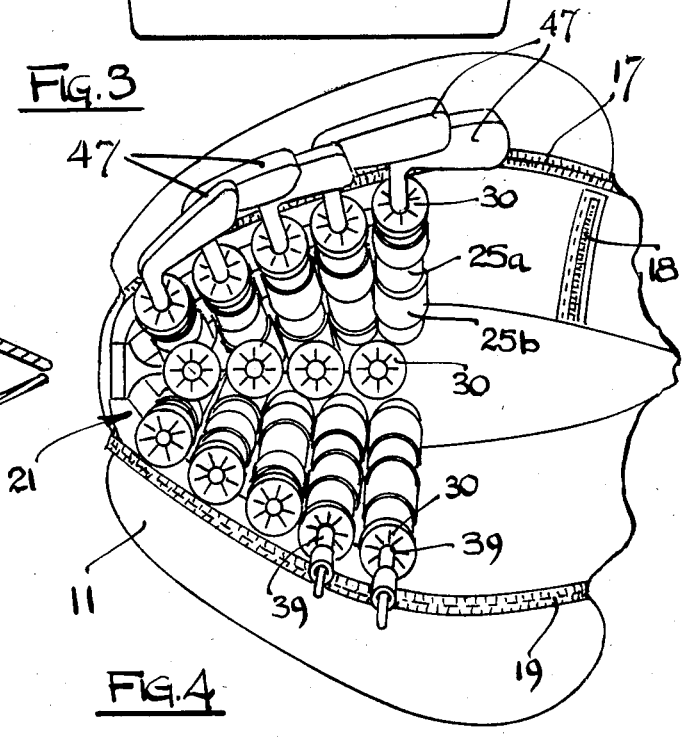
FIG. 4 is a top plan view taken of the preferred embodiment in an open condition.

Referring now to FIGS. 1, 3 and 4, a club head-shaft sections 38 and upper sections 39 are shown installed in their respective sleeve compartments. As can be seen in FIG. 4, the caps 30 retain the shaft in a central position. Further as shown in FIGS. 1 and 3, the shafts are vertically staggered by virtue of the stepped configuration of the sleeve compartments.

Figure 7:
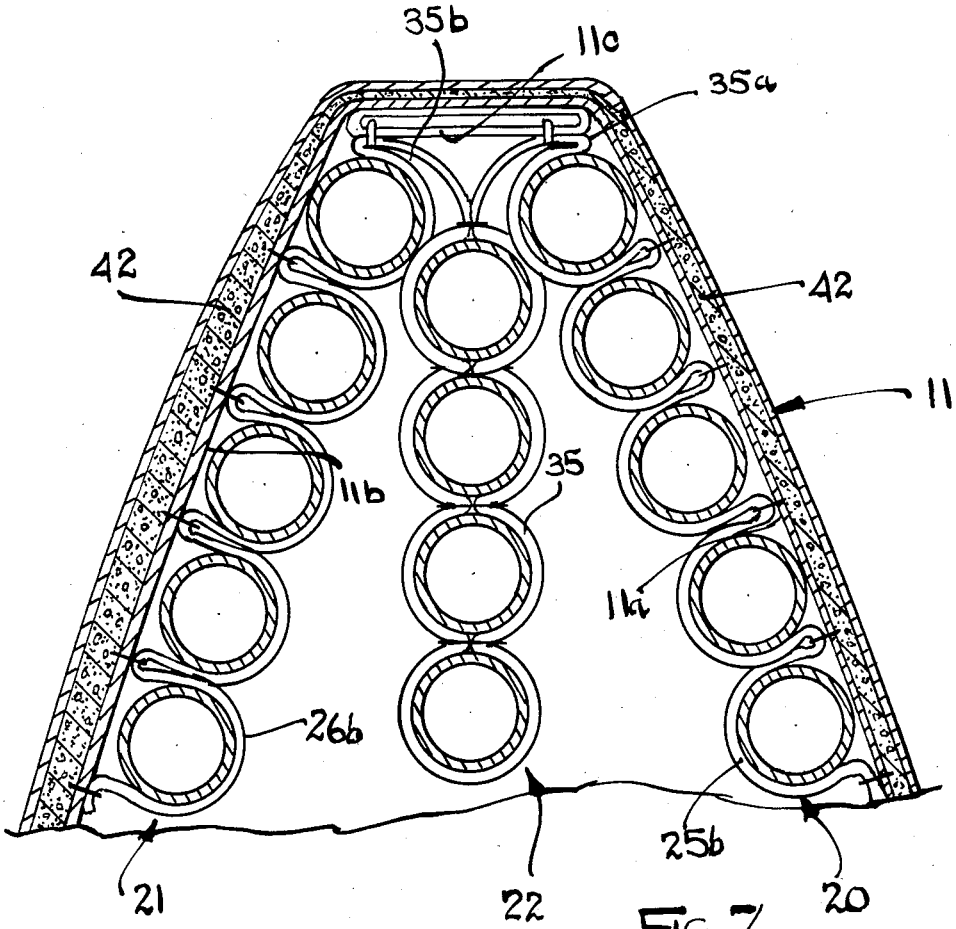
FIG. 7 is a top plan view illustrating the sleeve compartments for the club heads.
Figure 10:
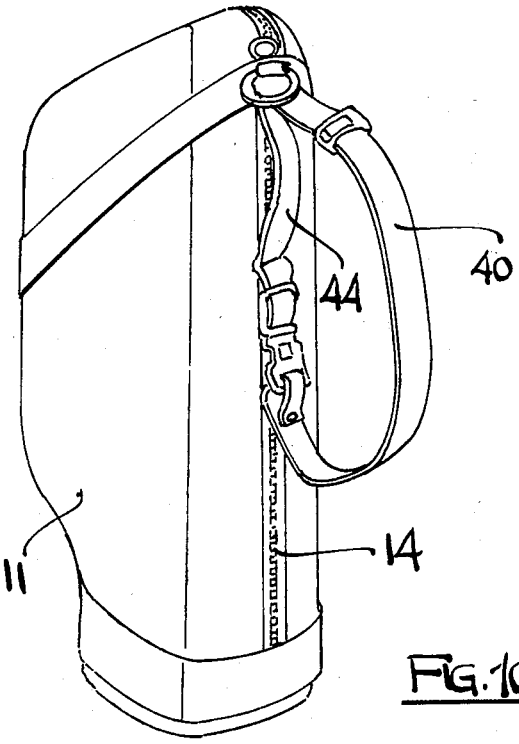
FIG. 10 is a perspective view illustrating the bag of the preferred embodiment in a fully closed condition.

As shown in FIG. 10 the bag includes a carrying strap 40 which is adjustable and detachable at one end. A hand strap 44 is also provided. These straps are positioned so that the bag is balanced while carrying when fully loaded. Further, as shown in FIG. 7 protective foam material 42 is provided between the inner and outer side walls of the bag to protect the contents thereof.

The device of the present invention thus provides a compact set which is particularly suitable by the travelling golfer and which does not comprise club performance.

While the invention has been described and illustrated in detail, it is to be clearly understood that this intended by way of illustration and example only and not to be taken by way of limitation, the spirit and scope of this invention being limited only by the terms of the following claims.

We claim:

1. A portable golf club set and carrying bag therefor comprising a plurality of golf club heads each having a shaft section of substantial length fixedly attached thereto, a top shaft section, and coupler means formed in said top shaft section and said club head shaft sections for providing a firm rigid joint between said top shaft section and any one of said club head shaft sections, said joint having substantially no slack either rotationally or longitudinally, said carrying bag having a plurality of sleeve members joined to each other to form a plurality of rows, said bag having opposite inner side walls, a first one of said rows of sleeve members being attached to one of said inner side walls, said bag having an inner end wall, a second one of said rows of sleeve members being pivotally attached at one end thereof to the inner end wall of said bag, sleeve members in each of said rows thereof being staggered in height to provide a stepped arrangement to facilitate separation identification and selection of the club heads, the club heads and top shaft section each being placed in one of said sleeve members.

2. The device of claim 1 wherein the carrying bag additionally includes a third one of said rows of sleeve members attached to the other of said inner side walls of said bag.

3. The device of claim 1 wherein said coupler means comprises splined interlocking coupler elements formed on said top shaft section and said club head shaft sections.

4. The device of claim 1 wherein said bag includes zippered inner side compartments.

5. The device of claim 1 and further including cap members attached to the top ends of each of the sleeve members, said cap members having resilient inwardly extending flexible fingers for gripping the shaft sections and removably retaining said shaft sections in centered positions within the sleeve member.

6. The device of claim 1 wherein the inner end wall of said bag is rigid and forms a spine for the bag enabling the bag to stand upright and to remain rigid while being carried.

7. The device of claim 1 wherein the bag further includes an adjustable carrying strap which is detachable from the bag at one end thereof.

* * * * *